US011453017B2

(12) United States Patent
Deshpande

(10) Patent No.: US 11,453,017 B2
(45) Date of Patent: Sep. 27, 2022

(54) LIQUID SLURRY SPRAYING SYSTEM

(71) Applicant: Spraying Systems Co., Wheaton, IL (US)

(72) Inventor: Narayan G. Deshpande, Bangalore (IN)

(73) Assignee: Spraying Systems Co., Wheaton, IL (US)

( * ) Notice: Subject to any disclaimer, the term of this patent is extended or adjusted under 35 U.S.C. 154(b) by 68 days.

(21) Appl. No.: 17/067,329

(22) Filed: Oct. 9, 2020

(65) Prior Publication Data

US 2021/0107017 A1 Apr. 15, 2021

Related U.S. Application Data

(60) Provisional application No. 62/912,962, filed on Oct. 9, 2019.

(51) Int. Cl.
*B05B 1/30* (2006.01)
*B05B 7/08* (2006.01)

(52) U.S. Cl.
CPC ..... *B05B 1/3046* (2013.01); *B05B 7/0815* (2013.01)

(58) Field of Classification Search
CPC ..... B05B 1/072; B05B 1/3046; B05B 3/04; B05B 7/02; B05B 7/14; B05B 7/0815
USPC ..... 239/469, 525, 526
See application file for complete search history.

(56) References Cited

U.S. PATENT DOCUMENTS 1,041,165 A * 10/1912 Riley ..... F16K 15/06 137/332
2,709,366 A * 5/1955 Potter ..... G01F 1/10 290/52
3,201,083 A * 8/1965 Schaus ..... G01F 1/10 416/223 R
3,622,126 A * 11/1971 Eberle ..... B29B 7/805 366/177.1
4,404,861 A * 9/1983 Wass ..... G01F 1/12 73/861.89
5,012,975 A * 5/1991 Korsmeyer ..... B01F 27/724 366/50
2014/0042246 A1* 2/2014 Buckner ..... B05B 3/04 239/381

* cited by examiner

*Primary Examiner* — Jason J Boeckmann
(74) *Attorney, Agent, or Firm* — Leydig, Voit & Mayer Ltd.

(57) ABSTRACT

A liquid slurry spraying system for spraying highly viscous slurries, including those with solids content, while maintaining the slurry in agitated condition for optimum discharge. The spraying system includes a nozzle body with a liquid flow passage having a liquid slurry inlet adjacent an upstream end and a spray tip at a downstream end, a valve needle supported in the liquid flow passage for reciprocating movement between spray tip closing and opening positions, and a bladed rotor having a plurality of vanes rotatably supported on the valve needle for rotation as an incident to the direction of liquid slurry from said liquid inlet when the valve needle is in an open position for agitating the liquid slurry for direction to the spray tip.

18 Claims, 3 Drawing Sheets

LIQUID SLURRY SPRAYING SYSTEM

CROSS-REFERENCE TO RELATED APPLICATION

This patent application claims the benefit of U.S. Provisional Patent Application No. 62/912,962, filed Oct. 9, 2019, which is incorporated by reference.

FIELD OF THE INVENTION

The present invention relates generally to air atomizing spray nozzle assemblies for spraying liquid slurries, and more particularly, to spray nozzles assemblies for spraying slurries having suspended particles mixed within the liquid.

BACKGROUND OF THE INVENTION

In many industries, a slurry must be coated onto a product to achieve the desired results. In the food industry, for example, various ingredients are used to coat the food product in order to achieve the required taste, such as for example, applying oil mixed with spices to produce spicy chips. Present practice often is to spray oil onto the food and then apply the spice powder uniformly onto it later. In industrial applications, such as porcelain enamel coating, a thin layer of ceramic or glass is applied to a substrate of metal to protect the surface from chemical or physical damage or to achieve desired physical qualities of the substrate, like high temperature resistance. In such cases, it has been difficult to achieve uniform coating by manual or other methods.

Spraying slurries that carry solid contents presents further problems. The liquid content of the slurry in this case is a carrying medium. The solids content of the slurry can settle down when transport velocity or other handling of the slurry is interrupted, and hence, it is important to maintain the homogeneity of the slurry throughout the process. Generally, homogeneity of the slurry can be achieved by mechanical agitation in storage tanks or vessels. While it would be desirable to spray such slurries, it is difficult to maintain the homogeneity of the slurry within a spray nozzle during coating operations.

External mix air atomizing nozzles have been useful in spraying highly viscous liquids without suspended particles. When such spray nozzles are used for slurry coating with suspended particles, it has been found that solid contents of the slurry tend to form clumps in the liquid path resulting in only the liquid being sprayed. This phenomenon happens in a relatively short period and leads to improper coating and eventual plugging of the spray nozzle. Indeed, maintaining uniformity with respect to density and coating thickness across an intended spray width is difficult in the case of any liquid with suspended contents.

SUMMARY OF THE INVENTION

It is an object of the present invention to provide an improved spray nozzle assembly that eliminates the necessity for multiple coating steps when applying slurries with solids content to a substrate surface or the like.

Another object is to provide an improved spray nozzle assembly as characterized above that is adapted for efficiently and effectively spraying slurries having solids contents.

Yet another abject is to provide a spray nozzle assembly of such type that is relatively simple in design and lends itself to economical manufacture.

Still a further object is to provide a spray nozzle assembly design which enables easy modification of conventional spray nozzles for achieving of the utility of the present invention.

Other objects and advantages of the invention will become apparent upon reading the following detailed description and upon reference to the drawings, in which:

Figure 1:
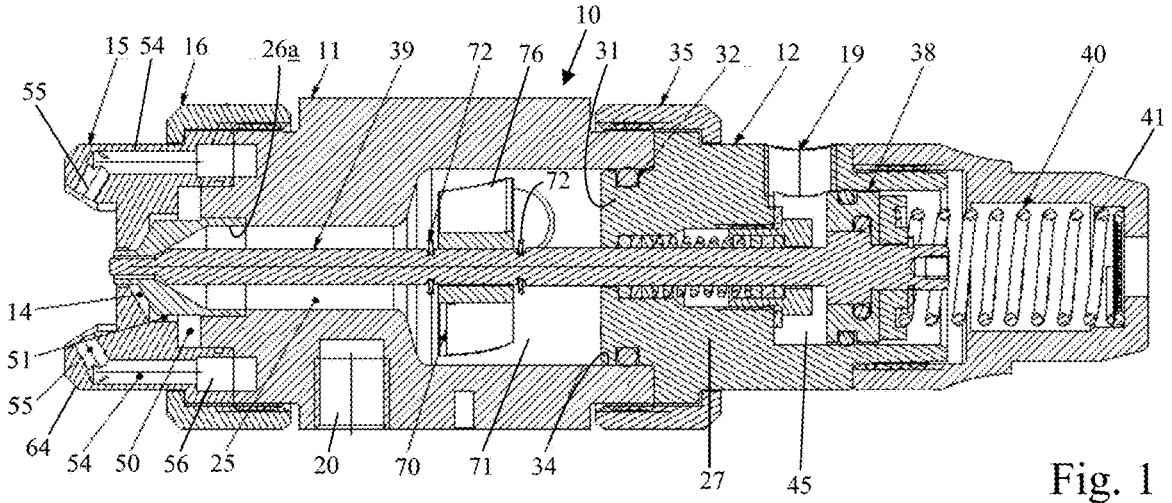
FIG. 1 is a longitudinal section of an illustrated spray nozzle assembly in accordance with the present invention.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DESCRIPTION OF THE PREFERRED EMBODIMENT

Figure 10:
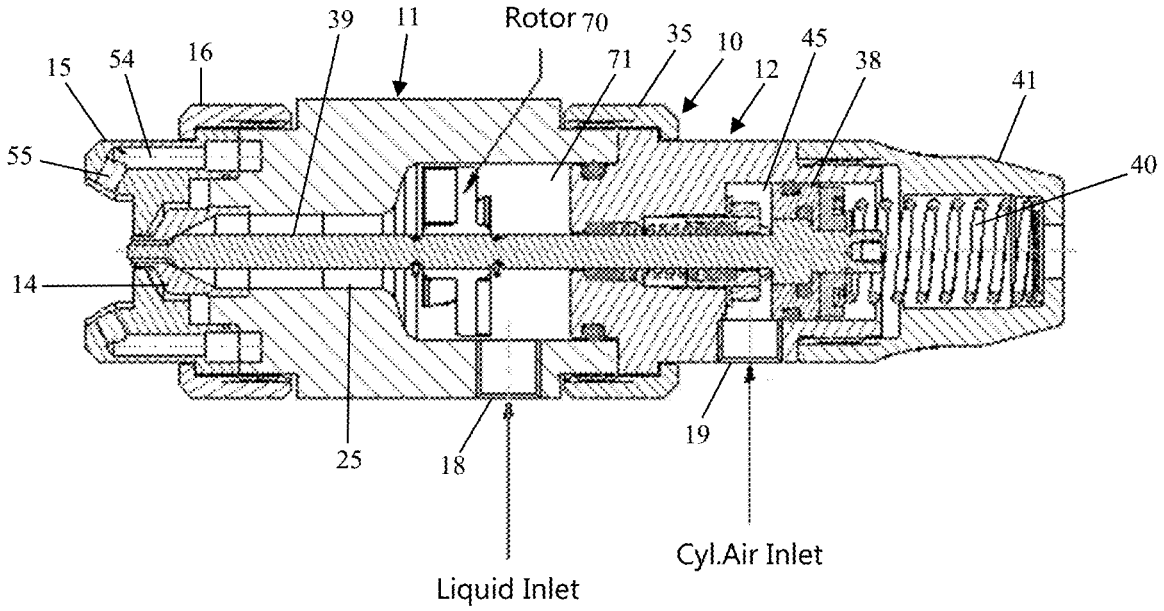
FIGS. 10 and 10*a* are enlarged sections of the illustrated spray nozzle assembly showing the valve needle in closed and open positions, respectively.

Referring now more particularly to the drawings, there is shown an illustrative external mix air assisted nozzle assembly 10 in accordance with the invention. The basic operation of the external mix air assisted spray nozzle assembly 10 is consistent with applicant's prior U.S. Pat. No. 7,717,059, the disclosure of which is incorporated herein by reference. The illustrated spray nozzle assembly 10, as best depicted in FIGS. 1 and 10 includes a main housing body 11, a control module 12, a spray tip 14 threadibly engaging a downstream end of the nozzle body 26, and an air cap 15 mounted in overlying surrounding relation to the spray tip 11 and retained on the main housing body 11 by a retaining nut 16.

Figure 2:
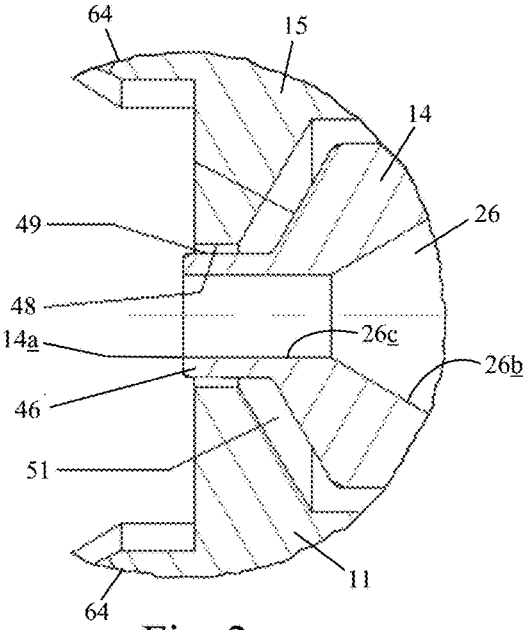
FIG. 2 is an enlarged fragmentary section of the downstream spray tip and air cap of the illustrated spray nozzle assembly.
Figure 3:
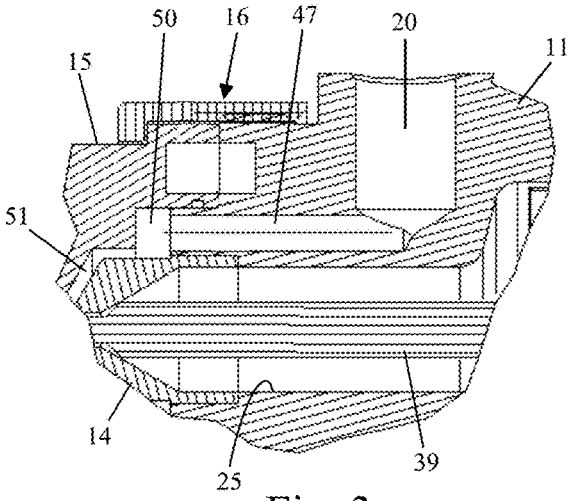
FIG. 3 is a further enlarged fragmentary section of the spray tip, air cap, and main nozzle body of the illustrated spray nozzle assembly.
Figure 4:
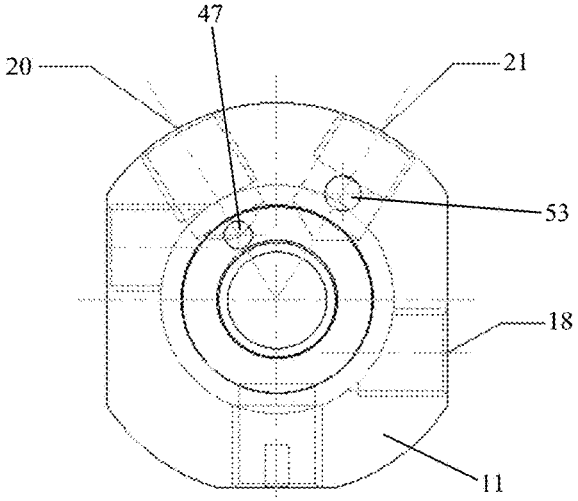
FIG. 4 is a downstream end view of the nozzle body of the illustrated spray nozzle assembly.

The illustrated main nozzle body 11 has a liquid slurry inlet port 18 (FIG. 10), a control module inlet port 19 (FIG. 10), an atomizing air inlet port 20 radially offset from the liquid inlet port 18 (FIG. 4), and a fan air inlet port 21 (FIG. 4). A liquid slurry, preferably having a liquid carrier and a solids content, is supplied to the liquid inlet port 18 from an appropriate liquid slurry supply and communicates with a central longitudinal passageway 25 in the main housing body 11, and in turn, with a liquid flow passage 26 in the spray tip 14 for discharge from a discharge orifice 14*a* of the spray tip 14 (FIG. 2). The spray tip flow passage 26 in this case is defined by an upstream cylindrical inlet section 26*a* communicating with the nozzle body passage 25, a tapered entry section 26*b*, and a smaller diameter nozzling section 26*c* that defines the discharge orifice 14*a* at a downstream end.

For controlling liquid flow and discharge of slurry through the spray tip 14, the control module 12 may be a standardized type that can be interchangeably mounted in the nozzle body 11. The control module 12 in this case comprises a body member 27 having a downstream relatively smaller diameter cylindrical hub portion 31 which carries an O-ring 32 and is positioned within an upstream cylindrical bore 34 of the nozzle body 11 and retained by a retaining nut 35 threadibly engageable with the nozzle body 11. The illustrated control module 12 includes a piston assembly 38 that has a downstream elongated piston rod in the form of a valve needle 39 for reciprocating movement with respect to the spray tip 14. The valve needle 39 extends axially through the liquid passage 25 with a downstream end that is engageable with the tapered entry section 26*b* of the spray tip 14 for interrupting liquid flow through the discharge orifice 14*a*. The piston assembly 38 is biased to the spray tip closing position by a biasing spring 40 interposed between the piston assembly 38 and an end cap 41 threadedly secured to an upstream end of the control module body member 27.

During operation, for axially moving the valve needle 39 to an open position (to the right as viewed in FIG. 1) against the force of the spring 40, control drive air or other fluid is supplied via the control module inlet port 19 into a cylindrical chamber 45 adjacent a forward side of the moveable piston assembly 38. As is known in the art, the control fluid, i.e., such as compressed air, may be controlled externally, such as by solenoid actuated valves, for controlling sequential opening and closing of the valve needle 11.

The spray tip 14 in this case has a forwardly extending nose portion 46 (FIG. 2) that defines the liquid discharge orifice 14*a* and which extends through a central opening 48 in the air cap 15 for defining an annular atomizing air discharge orifice 49 through which atomizing air supplied from the atomizing air inlet 20 is discharged. The atomizing air inlet 20 communicates with a longitudinal passage 47 (FIG. 4)*in* the nozzle body for communication with annular passages 50, 51 (FIG. 1) defined between the spray tip 14 and air cap 15, which in turn communicates with the annular air passage 49 about the spray tip nose portion 46 for atomizing liquid discharging from the spray tip 14.

To assist in forming the discharging spray pattern, the air cap 15 has two opposite longitudinal passages 54 (FIG. 1) which communicate with respective angled passages 55 through which fan air directed from the fan air inlet port 21 discharges for interaction and forming of a discharging spray pattern. The fan air in this case communicates from the fan air inlet port 201 through a longitudinal passage 53 (FIG. 4) in the nozzle body 11, an annular chamber 56 in the nozzle body 11, and the longitudinal and angled air cap passages 54, 55.

Figure 5:
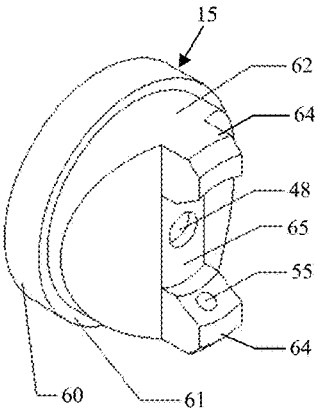
FIG. 5 is an enlarged front perspective of the air cap of the illustrated spray nozzle assembly.
Figure 6:
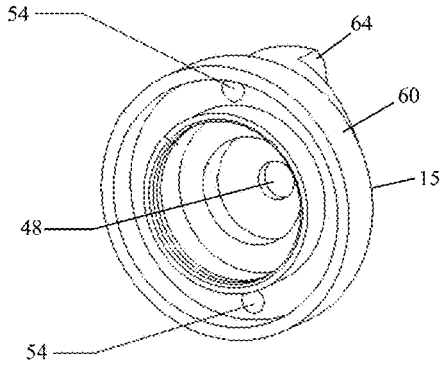
FIG. 6 is a rear or upstream perspective of the air cap shown in FIG. 5.
Figure 7:
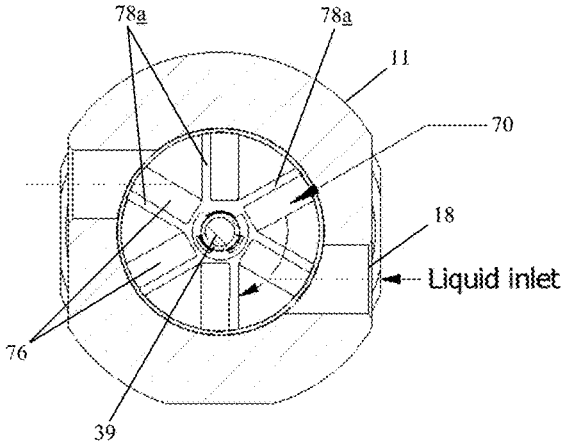
FIG. 7 is an enlarged vertical section of the main nozzle body showing the valve needle and liquid agitation rotor of the illustrated spray nozzle assembly.
Figure 8:
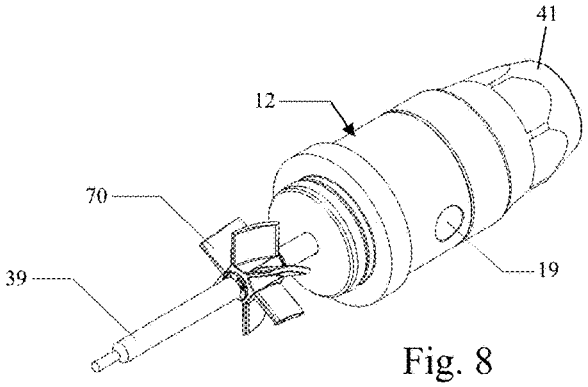
FIG. 8 is an enlarged perspective of the control module, valve needle and liquid agitating rotor of the illustrated spray nozzle assembly.

The fan air discharge minimizes both fine particle accumulation around the fan air discharge orifices and pressurized air operating requirements. The illustrated air cap 15, as depicted in FIG. 5, has an upstream cylindrical side wall 60 which defines a transverse ledge 61 and a smaller diameter forwardly extending cylindrical base 62 with a pair of ears or projections 64 extending forwardly from diametrically opposite sides of the base 62. The angled fan air passages 55 of the air cap 15 communicate with the respective longitudinal air cap passageways 54 and extend in inwardly and forwardly directed relation to an air cap end face 65. The angled passageways 55 preferably are oriented at a relatively steep angle to the discharging liquid flow stream for maximizing impingement and atomization of the discharging liquid at lower air pressures and air volume for minimizing material build-up about the fan air discharge orifices. In the illustrated embodiment, the angled fan air passages 55 are oriented at an angle of about 60° with respect to a line perpendicular to the axis of the discharging atomized liquid flow stream.

In accordance with an important aspect of the present embodiment, the spray nozzle assembly includes a self-contained rotor which is actuated upon the introduction of pressurized slurry into the nozzle assembly for agitating the slurry to maintain its homogeneity and prevent settling and agglomeration of the solid contents within the spray nozzle. In the illustrated embodiment, a rotor 70 is rotatably mounted on the valve needle 39 for relative rotation and agitation of the liquid slurry as an incident to introduction of the liquid under pressure from the liquid inlet port 18. The main nozzle body 11 in this case defines an enlarged annular chamber 71 immediately upstream and in communication with the liquid flow passage 25 within which the rotor 70 is disposed. The rotor 70 is axially retained on the valve needle 39 by annular clips 72 affixed to the valve needle 39 on the upstream and downstream sides of the rotor 70. The illustrated rotor 70 has a central cylindrical hub section 74 with a central cylindrical opening 75 for rotatably mounting on the valve needle 39 and a plurality of blades or vanes 76, in this case, is disposed in angled relation to the longitudinal axis of the rotor 70 and valve needle 39.

Figure 9:
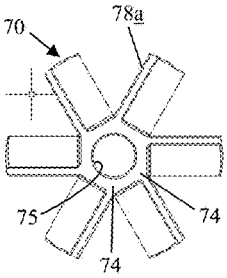
FIG. 9 is an enlarged downstream end view of the liquid agitation rotor of the illustrated spray nozzle assembly.
Figure 9A:
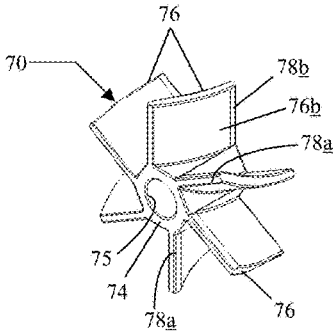
FIG. 9*a* is a front perspective of the liquid agitation rotor shown in FIG. 9.
Figure 9B:
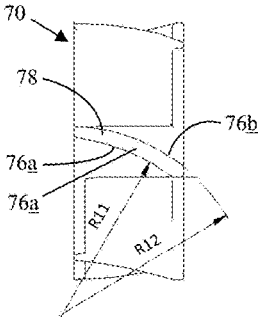
FIG. 9*b* is a side elevational view of the liquid agitation rotor shown FIGS. 9 and 9*a*.
Figure 10A:
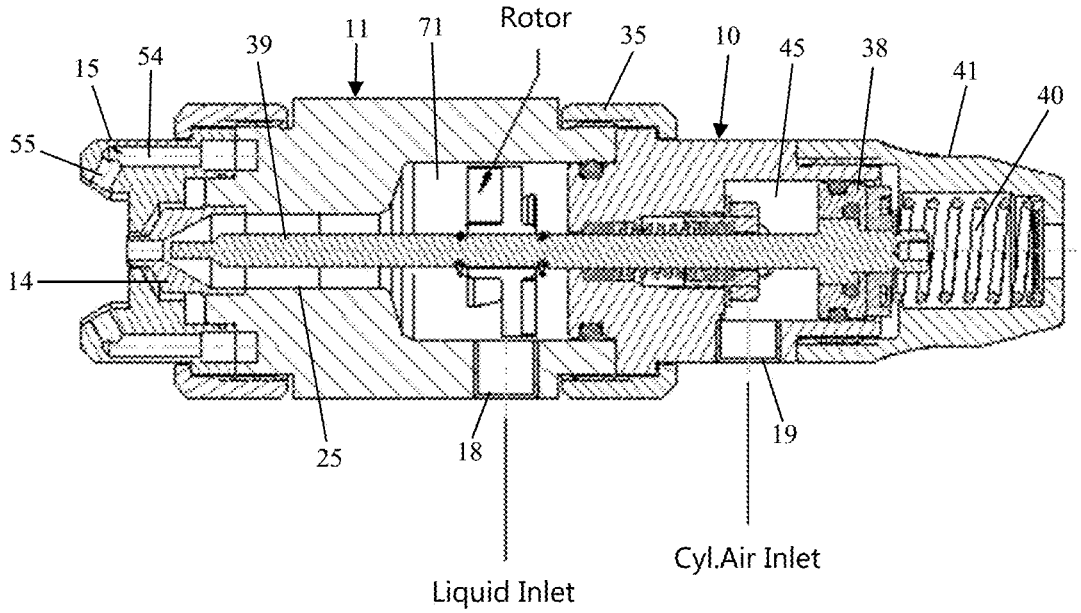

In keeping with this embodiment, the blades 76 are designed such that upon engagement by pressurized liquid from the liquid inlet port 18 the rotor 76 is continuously rotated for agitating the liquid and maintaining its homogeneity and the agitated liquid is directed downstream into and through the liquid flow passage 25 and spray tip 14. To this end, rotor blades 76 are preferably disposed at angles of between 15 and 25 degrees to the longitudinal axis of the support hub 74 and have slightly curved configurations with inwardly and outwardly curved sides 76*a*, 76*b* respectively (FIGS. 9-9*b*). The rotor 70 is mounted on the valve needle 39 such that the outwardly curved sides 76*b* of the rotors successively come into direct contact with pressurized liquid slurry directed from the liquid inlet port 18. When the blades 76 are in aligned with the liquid inlet port 18 (FIG. 10*a*), it can be seen that pressurized liquid will directly impinge the outwardly curved sides 76*b* of the rotor blades for both rotating the rotor and agitating the liquid. Moreover, downstream ends 78*a* of the blades 76 are disposed a greater distance from the liquid inlet than the upstream ends 78*b* such that the skewed curved sides of the blades 70 impart rotation to the blades and guide and direct the liquid in a downstream direction. Hence, liquid impingement upon the successive blades 76 of the rotor 70 will continuously rotate the rotor to agitate the liquid, and redirect the liquid flow in a downstream direction for discharge from the spray tip 14 without the solids contents of the slurry settling out or clogging the spray tip.

As depicted in FIG. 10, upon de-actuation of the control module upon interruption of pressurized gas to the control module inlet port 19, the valve needle 39 is moved to a closed position under the force of the biasing spring 40, simultaneously carrying the rotor 70 with it in a downstream direction out of alignment with the liquid inlet port into the chamber 71. On the other hand, upon actuation of the control module 12, through the direction of pressurized gas to the inlet port 19, movement of the piston assembly 38 against the biasing force of the spring 40 to the valve opening position the rotor 70 is automatically into its operative position with the rotor blades 76 in aligned relation to liquid directed for liquid inlet port 18.

Hence, in operation, it has surprisingly been found that the spray nozzle assembly can effectively spray highly viscous slurries with solid particle content while maintaining the slurry in agitated condition within the spray nozzle for optimum discharge and coating onto products being sprayed, without settling out of the solid particles or clogging of the spray nozzle assembly during operation. Yet the construction and operation of the spray nozzle assembly is relatively simple, requiring only the addition of an appropriately configured rotor on the valve needle and a nozzle body having a rotor receiving chamber upstream of the liquid flow passage to the spray tip.

What is claimed:

1. A liquid slurry spraying system comprising: a nozzle body having a spray tip with a discharge orifice at a downstream end of the nozzle body; said nozzle body having a liquid flow passage communicating with said spray tip; a supply of liquid slurry; said nozzle body having a liquid slurry inlet communicating with said liquid flow passage from said liquid slurry supply for directing liquid slurry into said flow passage for discharge from said spray tip discharge orifice; an elongated rod supported axially within said liquid flow passage; and a bladed rotor rotatably supported on said elongated rod within said nozzle body adjacent an upstream end of said liquid flow passage across from said liquid inlet for rotation relative to said elongated rod as an incident to the direction of liquid slurry from said liquid inlet into said liquid flow passage for agitating the liquid slurry for direction to said spray tip; wherein said elongated rod is the piston rod of a piston assembly that is operable for reciprocating the piston rod between a forward spray tip closing position interrupting the discharge of liquid slurry from said spray tip discharge orifice and a retracted open position for enabling the direction of liquid slurry from said liquid inlet, through said flow passage, and discharge from said spray tip discharge orifice.

2. The liquid slurry spraying system of claim 1 in which said supply of liquid slurry is a supply of a liquid slurry containing solids.

3. The liquid slurry spraying system of claim 2 in which said bladed rotor has a plurality of circumferentially spaced vane elements.

4. The liquid slurry spraying system of claim 3 in which said vanes each are disposed in angled relation to a longitudinal axis of the liquid flow passage.

5. The liquid slurry spraying system of claim 4 in which said vanes each are disposed at an angle of between 15 and 25 degrees to the longitudinal axis of said liquid flow passage.

6. The liquid slurry spraying system of claim 4 in which said vanes each having a curved configuration with inwardly and outwardly curved sides and with the outwardly curved sides having a larger radius curvature than the inwardly curved sides, and the said rotor being rotatably supported with the outwardly curved sides of said vanes successively coming into direct contact with liquid slurry directed into the liquid flow passage from said liquid inlet.

7. The liquid slurry spraying system of claim 6 in which said vanes have downstream ends disposed a greater distance from the liquid inlet than upstream ends such that liquid slurry directed from said liquid inlet imparts rotation to the vanes and is directed in a downstream direction through said liquid flow passage.

8. A liquid slurry spraying system comprising:

a nozzle body having a spray tip with a discharge orifice at a downstream end of the nozzle body;

said nozzle body having a liquid flow passage communicating with said spray tip;

a supply of liquid slurry;

said nozzle body having a liquid slurry inlet communicating with said liquid flow passage from said liquid slurry supply for directing liquid slurry into said flow passage for discharge from said spray tip discharge orifice;

a valve needle supported in said liquid flow passage for reciprocating movement between a forward spray tip closing position interrupting the discharge of liquid slurry from said spray tip discharge orifice and a retracted open position for enabling the direction of liquid slurry from said liquid inlet, through said liquid flow passage, and discharge from said spray tip discharge orifice;

and a bladed rotatably supported on said valve needle within said nozzle body adjacent an upstream of said liquid flow passage across from said liquid inlet for rotation as an incident to the direction of liquid slurry from said liquid inlet into said liquid flow passage for agitating the liquid slurry for direction to said spray tip.

9. The liquid slurry spraying system of claim 1 in which said nozzle body has an atomizing air inlet, an air cap supported at a downstream end of said nozzle body in surrounding relation to said spray tip, and said nozzle body and air cap having an air passage system for directing pressurized air about liquid discharging from said spray tip discharge orifice for atomizing and shaping liquid slurry discharging from the spray tip discharge orifice.

10. A liquid slurry spraying system comprising:

a nozzle body having a spray tip with a discharge orifice at a downstream end of the nozzle body;

said nozzle body having a liquid flow passage communicating with said spray tip;

said nozzle body having a liquid inlet communicating with liquid flow passage from a liquid slurry supply for directing liquid slurry into said flow passage for discharge from said spray tip discharge orifice;

a valve needle supported in liquid flow passage for reciprocating movement between a forward spray tip closing position interrupting the discharge of liquid slurry from said spray tip discharge orifice and a retracted open position for enabling the direction of liquid slurry from said liquid inlet, through said flow passage, and discharge from said spray tip discharge orifice;

and a bladed rotor having a plurality of circumferentially spaced vanes rotatably supported on said valve needle for rotation as an incident to the direction of liquid slurry through said liquid inlet into said liquid flow passage for agitating the liquid slurry for direction to said spray tip.

11. The liquid slurry spraying system of claim 10 in which bladed rotor is mounted on said valve needle for movement with said valve needle between said forward and retracted positions, and said bladed rotor being disposed adjacent said liquid inlet when said valve needle is in said retracted position for direct engagement by liquid directed to liquid flow passage from said liquid inlet.

12. The liquid slurry spraying system of claim 10 in which said vanes each are disposed in angled relation to a longitudinal axis of the liquid flow passage.

13. The liquid slurry spraying system of claim 12 in which said vanes each are disposed at an angle of between 15 and 25 degrees to the longitudinal axis of said liquid flow passage.

14. The liquid slurry spraying system of claim 12 in which said vanes each having a curved configuration with inwardly and outwardly curved sides and with the outwardly curved sides having a larger radius curvature than the inwardly curved sides, and the said rotor being supported with the outwardly curved sides of said vanes successively coming into direct contact with liquid slurry directed into the liquid flow passage from said liquid inlet.

15. The liquid slurry spraying system of claim 14 in which said vanes have downstream ends disposed a greater distance from the liquid inlet than upstream ends such that liquid slurry directed from said liquid inlet both imparts rotation to the vanes and directs liquid in a downstream direction through said liquid flow passage.

16. The liquid slurry spraying system of claim 10 in which said nozzle body has a fan air inlet, an air cap supported at a downstream end of said nozzle body in surrounding relation to said spray tip, said air cap having fan air discharge orifices on opposing sides of the spray tip liquid discharge orifice, and said nozzle body and air cap having an air passage system for directing pressurized air from said fan air inlet to said air cap discharge orifices for forming liquid discharging from said spray tip discharge orifice.

17. The liquid slurry spraying system of claim 16 in which nozzle body have an atomizing air inlet, said air cap having a central opening, said spray tip having a forwardly extending nose portion extending through said air cap central opening which together with said central opening defines an atomizing air discharge orifice, and said nozzle body and air cap defining an air passage system for directing pressurized air from said atomizing air inlet to said atomizing air discharge orifice for atomizing liquid discharging from said spray tip discharging orifice.

18. The liquid slurry spraying system of claim 8 in which said bladed rotor is supported on said valve needle for reciprocating movement with said valve needle, and said bladed rotor is disposed adjacent said liquid inlet when said valve needle is in said retracted position for direct engagement by liquid directed to liquid flow passage from said liquid inlet.

* * * * *